United States Patent [19]

Zinser

[11] Patent Number: 4,980,916

[45] Date of Patent: Dec. 25, 1990

[54] METHOD FOR IMPROVING SPEECH QUALITY IN CODE EXCITED LINEAR PREDICTIVE SPEECH CODING

[75] Inventor: Richard L. Zinser, Schenectady, N.Y.

[73] Assignee: General Electric Company, Schenectady, N.Y.

[21] Appl. No.: 427,074

[22] Filed: Oct. 26, 1989

[51] Int. Cl.[5] ..... G10L 5/00

[52] U.S. Cl. ..... 381/36; 381/31; 381/49; 381/38; 381/47

[58] Field of Search ..... 381/36, 31, 38, 47, 381/49

[56] References Cited

PUBLICATIONS

B. S. Atal and M. R. Schroeder, "Stochastic Coding of Speech Signals at Very Low Bit Rates", *Proc. of 1984 IEEE Int. Conf. on Communications,* May 1984, pp. 1610–1613.

M. R. Schroeder and B. S. Atal, "Code-Excited Linear Prediction (CELP): High Quality Speech at Very Low Bit Rates", *Proc. of 1985 IEEE Int. Conf. of Acoustics, Speech, and Signal Processing,* Mar. 1985, pp. 937–940.

B. S. Atal, and J. R. Remde, "A New Model of LPC Excitation for Producing Natural Sounding Speech at Low Bit Rates", *Proc. of 1982 IEEE Int. Conf. on Acoustics, Speech, and Signal Processing,* May 1982, pp. 614–617.

P. Kroon and B. S. Atal, "Strategies for Improving the Performance of CELP Coders at Low Bit Rates", *Proc. of 1988 Int. Conf. on Acoustics, Speech, and Signal Processing,* Apr. 1982, pp. 151–154.

B. S. Atal, "Predictive Coding of Speech at Low Bit Rates", *IEEE Transactions on Communications,* vol. COM-30, Apr. 1982, pp. 600–614.

*Primary Examiner*—Emanuel S. Kemeny

*Attorney, Agent, or Firm*—Marvin Snyder; James C. Davis, Jr.

[57] ABSTRACT

By reconciling differences between the estimator and the filter of a code excited linear predictive (CELP) voice coder, higher quality is achieved in the output speech. The pulse amplitudes and pitch tap gain are solved for simultaneously to minimize the estimator bias in the CELP excitation. Increased signal to noise ratio is accomplished by modifying the pitch predictor such that the pitch synthesis filter accurately reflects the estimation procedure used to find the pitch tap gain, and by improving the excitation analysis technique such that the pitch predictor tap gain and codeword gain are solved for simultaneously, rather than sequentially. These modifications do not result in an increased transmission rate or significant increase in complexity of the CELP coding algorithm.

6 Claims, 5 Drawing Sheets

METHOD FOR IMPROVING SPEECH QUALITY IN CODE EXCITED LINEAR PREDICTIVE SPEECH CODING

CROSS-REFERENCE TO RELATED APPLICATION

This application is related in subject matter to Richard L. Zinser applications Ser. No. 07/353,856 filed May 18, 1989, for "Method for Improving the Speech Quality in Multi-Pulse Excited Linear Predictive Coding" and Ser. No. 07/353,855 filed May 18, 1989, for "Hybrid Switched Multi-Pulse/Stochastic Speech Coding Technique", both of which are assigned to the instant assignee. The disclosures of those applications are hereby incorporated by reference.

BACKGROUND OF THE INVENTION

1. Field of the Invention

This invention relates to digital voice transmission systems and, more particularly, to a new technique for increasing the signal-to-noise ratio (SNR) in a code excited linear predictive (CELP) speech coder.

2. Description of the Prior Art

An early description of CELP coding was published by M. R. Schroeder and B. S. Atal in "Stochastic Coding of Speech Signals at Very Low Bit Rates", *Proc. of* 1984 *IEEE Int. Conf. on Communications*", May 1984, pp. 1610–1613, although a better description can be found in M. R. Schroeder and B. S. Atal, "Code-Excited Linear Prediction (CELP): High-Quality Speech at Very Low Bit Rates", *Proc. of* 1985 *IEEE Int. Conf. on Acoustics, Speech, and Signal Processing,* March 1985, pp. 937–940. The basic technique comprises searching a codebook of randomly distributed excitation vectors for the vector that produces an output sequence (when filtered through pitch and linear predictive coding (LPC) short-term synthesis filters) that is closest to the input sequence. To accomplish this task, all of the candidate excitation vectors in the codebook must be filtered with both the pitch and LPC synthesis filters to produce a candidate output sequence that can then be compared to the input sequence. This makes CELP a very computationally-intensive algorithm, with typical codebooks consisting of 1024 entries, each 40 samples long. In addition, a perceptual error weighting filter is usually employed, which adds to the computational load. A block diagram of a known implementation of the CELP algorithm is shown in FIG. 1, and FIG. 2 shows some example waveforms illustrating operation of the CELP method.

SUMMARY OF THE INVENTION

One object of the present invention, therefore, is to provide a modification to existing CELP speech coders that improves the speech quality without increasing the transmission rate.

Another object of the invention is to provide a technique for reconciling the differences between the estimated gain of a CELP coder pitch predictor and a pitch predictor recursive filter in which the gain will be used, so as to achieve higher quality output speech.

Another object of the invention is to provide a technique that simultaneously solves for codeword gain and pitch tap gain to minimize estimator bias in the excitation of a CELP speech coder to improve performance of the coder.

Briefly, in accordance with a preferred embodiment of the invention, increased SNR in a CELP speech coder is accomplished by first modifying the pitch predictor thereof such that the pitch synthesis filter employed therein accurately reflects the estimation procedure used to determine pitch tap gain and, second, improving the excitation analysis technique such that the pitch predictor tap gain and codeword gain are solved for simultaneously, rather than sequentially. Neither of these pitch predictor modifications results in an increased transmission rate or a significant increase in complexity of the CELP coding algorithm.

BRIEF DESCRIPTION OF THE DRAWING

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DETAILED DESCRIPTION OF A PREFERRED EMBODIMENT OF THE INVENTION

Figure 1:
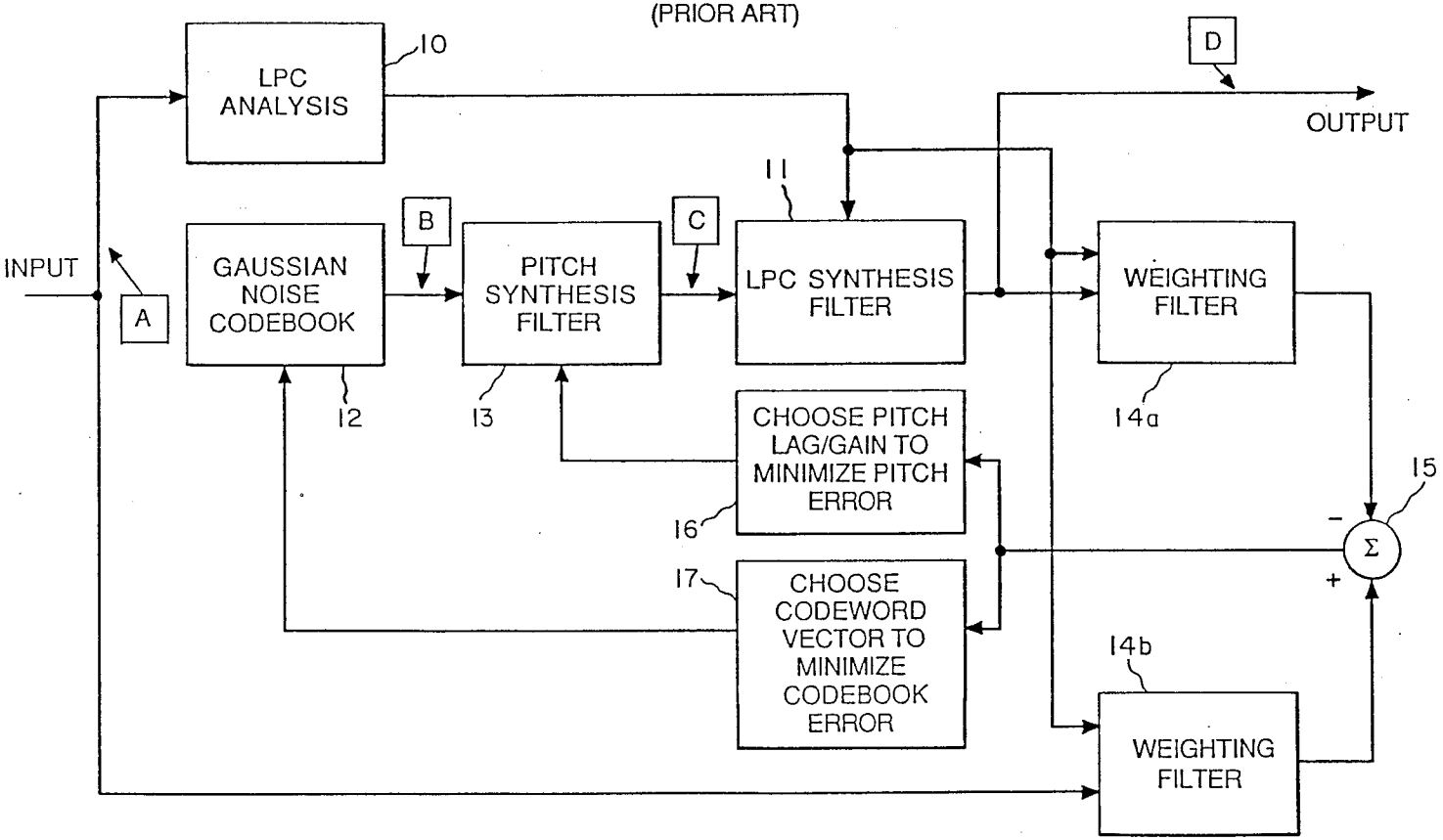
FIG. 1 (PRIOR ART)
FIG. 1 is a block diagram showing a known implementation of the basic CELP technique.
Figure 2:
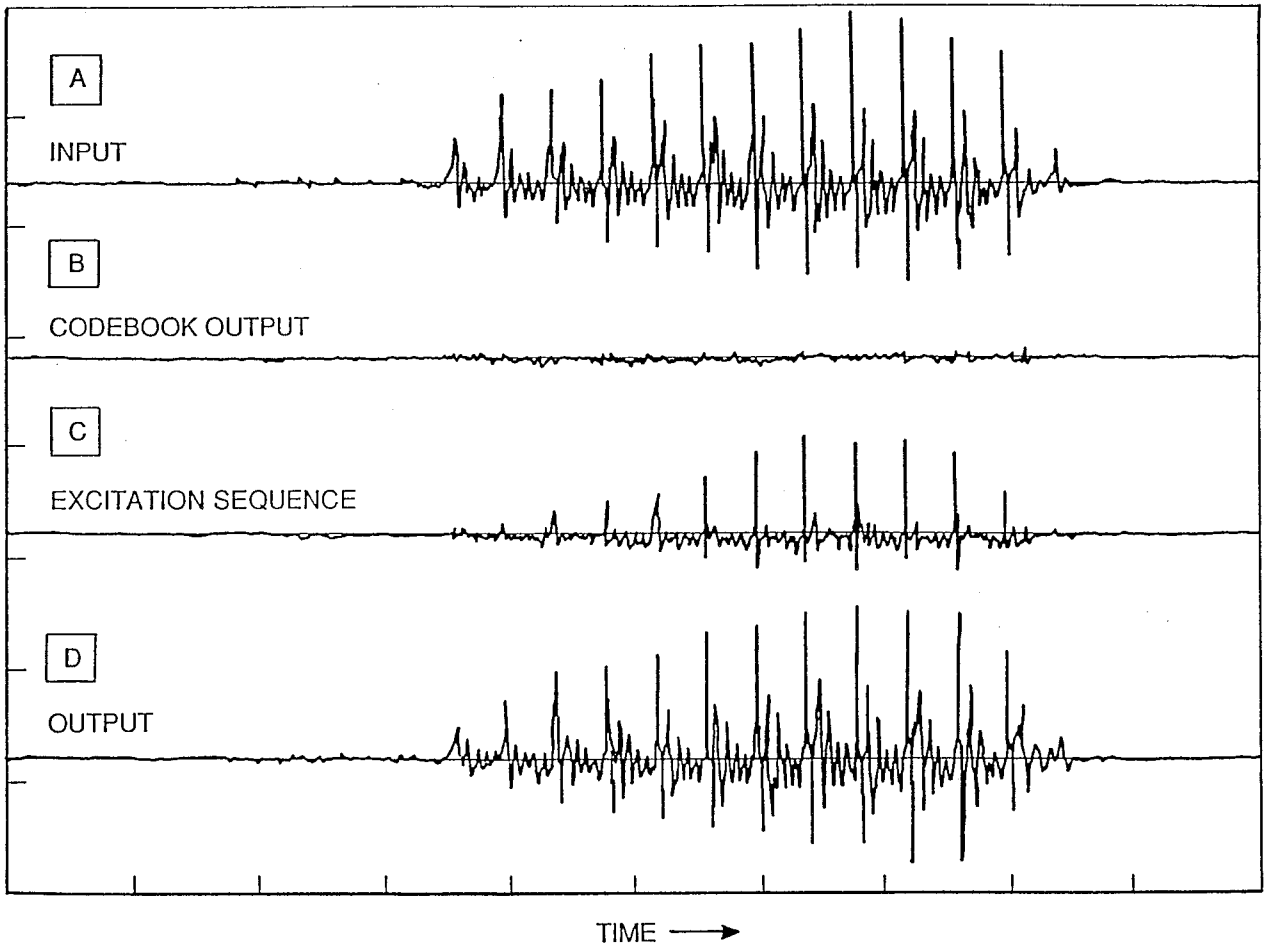
FIG. 2 (PRIOR ART)
FIG. 2 is a graphical representation of signals at various points in the circuit of FIG. 1, illustrating operation of that circuit.

With reference to the known implementation of the basic CELP technique, represented by FIGS. 1 and 2, the input signal at "A" in FIG. 1 and shown as waveform "A" in FIG. 2, is first analyzed in a linear predictive coding analysis circuit 10 so as to produce a set of linear prediction filter coefficients. These coefficients, when used in an all-pole LPC synthesis filter 11, produce a filter transfer function that closely resembles the gross spectral shape of the input signal. Thus the linear prediction filter coefficients and parameters representing the excitation sequence comprise the coded speech which is transmitted to a receiving station (not shown). Transmission is typically accomplished via multiplexer and modem to a communications link which may be wired or wireless. Reception from the communications link is accomplished through a corresponding modem and demultiplexer to derive the linear prediction filter coefficients and excitation sequence which are provided to a matching linear predictive synthesis filter to synthesize the output waveform "D" that closely resembles the original speech.

Linear predictive synthesis filter 11 is used in the transmitting portion of the system to generate excitation sequence "C". More particularly, a Gaussian noise codebook 12 is searched to produce an output signal "B" that is passed through a pitch synthesis filter 13 that generates excitation sequence "C". A pair of weighting filters **14*a* and 14*b* each receive the linear prediction coefficients from LPC analysis circuit 10. Filter 14*a* also receives the output signal of LPC synthesis filter 11 (i.e., waveform "D"), and filter 14*b* also receives the input speech signal (i.e., waveform "A"). The difference between the output signals of filters 14a and 14b is generated in a summer 15 to form an error signal. This error signal is supplied to a pitch error minimizer 16 and a codebook error minimizer 17**.

A first feedback loop formed by pitch synthesis filter 13, LPC synthesis filter 11, weighting filters 14a and 14b, and codebook error minimizer 17 exhaustively searches the Gaussian noise codebook to select the output signal that will best minimize the error from summer 15. In addition, a second feedback loop formed by LPC synthesis filter 11, weighting filters 14a and 14b, and pitch error minimizer 16 has the task of generating a pitch lag and gain for pitch synthesis filter 13, which also minimizes the error from summer 15. Thus the purpose of the feedback loops is to produce a waveform at point "C" which causes LPC synthesis filter 11 to ultimately produce an output waveform at point "D" that closely resembles the waveform at point "A". This is accomplished by using codebook error minimizer 17 to choose the codeword vector and a scaling factor (or gain) for the codeword vector, and by using pitch error minimizer 16 to choose the pitch synthesis filter lag parameter and the pitch synthesis filter gain parameter, thereby minimizing the perceptually weighted difference (or error) between the candidate output sequence and the input sequence. Each of codebook error minimizer 17 and pitch error minimizer 16 is implemented by a respective minimum mean square error estimator (MMSE). Perceptual weighting is provided by weighting filters 14a and 14b. The transfer function of these filters is derived from the LPC filter coefficients. See, for example, the article by B. S. Atal and J. R. Remde entitled "A New Model of LPC Excitation for Producing Natural Sounding Speech at Low Bit Rates", *Proc. of* 1982 *IEEE Int. Conf. on Acoustics, Speech, and Signal Processing*, May 1982, pp. 614–617, for a complete description of the method.

To determine the optimum or "best" codeword excitation vector, a minimum mean-square error (MMSE) criterion is used. To use this criterion, an optimal gain factor for each codeword vector is calculated by normalizing the cross-correlation between the filtered codeword and the input signal, i.e., $$g = \frac{\sum_{i=0}^{N-1} y(i)x(i)}{\sum_{i=0}^{N-1} y^2(i)} \tag{1}$$

where g is the gain, x(i) is the (weighted) input signal, y(i) is the synthesis-filtered (and weighted) codeword, and N is the frame length. The optimum codeword is selected by choosing the one that yields the maximum of the following quantity:

$$g' = \frac{\left[\sum_{i=0}^{N-1} y(i)x(i)\right]^2}{\sum_{i=0}^{N-1} y^2(i)} \tag{2}$$

It is well known that a pitch predictor is required in a CELP coder. Research by P. Kroon and B. S. Atal as reported in "Strategies for Improving the Performance of CELP Coders at Low Bit Rates", *Proc. of* 1988 *IEEE International Conf. on Acoustics, Speech, and Signal Processing*, April 1982, pp. 151–154, has shown that the pitch predictor is the main contributor to voiced speech quality. The pitch predictor comprises a recursive, infinite impulse response (IIR) digital filter with a single tap placed at a lag equal to the number of samples in the pitch period:

$$y(i) = \beta y(i-P) + e(i), \tag{3}$$

where e(i) is the codeword excitation sequence, y(i) is the pitch predictor output sequence, $\beta$ is the pitch predictor tap gain, and P is the pitch lag. To solve for $\beta$ and P, the lag (P) is first estimated by the location of the peak cross-correlation between the filtered samples in the pitch buffer and the input sequence. The gain ($\beta$) is then given by the normalized cross-correlation $$\beta = \frac{\sum_{i=0}^{N-1} y_s(i-P)x(i)}{\sum_{i=0}^{N-1} y_s^2(i-P)}, \tag{4}$$

where x(i) is the input sequence, $y_s(i)$ represents the synthesis-filtered pitch buffer samples (i.e., y(i) passed through LPC synthesis filter 11), and N is the frame length. Examination of Equations (3) and (4) reveals a problem in computing the pitch predictor gain and delay lag; that is, if the pitch lag P is shorter than the frame length N, the sums in Equation (4) require values from the pitch buffer y(i−P) that have not yet been synthesized (i.e., when i−P is equal to or greater than 0). There has not been a published solution for this causality problem. A preferred method for finding $\beta$ is simply to extend the pitch buffer by copying previous values at a distance of P samples:

$$\beta = \frac{\sum_{i=0}^{P-1} y_s(i-P)x(i) + \sum_{i=P}^{N-1} y_s(i-2P)x(i)}{\sum_{i=0}^{P-1} y_s^2(i-P) + \sum_{i=P}^{N-1} y_s^2(i-2P)}, \text{ for } P < N < 2P. \tag{5}$$

Equation (5) assumes that 2P is greater than N. It is a simple matter to further extend the pitch buffer for shorter pitch lags/longer frame lengths.

The value for $\beta$ given in Equation (5) is only an approximation if the standard pitch synthesis filter of Equation (3) is used. The estimated value for $\beta$ will be correct only if the sequence being synthesized is perfectly periodic; i.e., $\beta = 1.0$. While this method has been used with reasonable success in systems where the frame length is relatively short (i.e., when P is usually greater than N, but only occasionally less than N), it will perform very poorly when N is increased such that the value taken on by P is frequency less than N. Another problem with using Equation (5) to estimate values for Equation (3) lies in the fact that the system will not perform properly when used with a simultaneous solution.

To solve the mismatch problem between the estimator in Equation (5) and the pitch predictor synthesis filter in Equation (3), the pitch synthesis filter is modified as follows:

$$y(i) = \begin{cases} \beta y(i-P) + e(i), & i < P \\ \beta y(i-2P) + e(i), & P \leqq i < 2P \\ \beta y(i-3P) + e(i), & 2P \leqq i < 3P \\ \text{etc.} \end{cases} \quad (6)$$

The use of Equation (6) with the results of Equation (5) removes any error or estimator bias in the tap gain $\beta$, since the data used in the calculation of $\beta$ corresponds exactly to the data used to generate the output sequence y(i). Furthermore, the system is causal, with all coefficients being estimated from the previous frame's data. One possible drawback of Equation (6) is that the excitation from the present frame (e(i)) cannot contribute to the pitch predictor; however, as will be shown below, the new system still outperforms the standard CELP algorithm, even though the standard algorithm has no such limitation.

Using the above pitch prediction technique, the equations for the simultaneous solution of the pulse amplitudes and pitch tap gain may now be developed. The error to be minimized is given by $$E^2 = \sum_{i=0}^{N-1} [x(i) - \beta y_P(i) - g y_C(i)]^2, \quad (7)$$

where x(i) is the perceptually weighted input sequence, g is the codeword gain, $y_C(i)$ is the weighted LPC synthesis filtered codeword, $\beta$ is the pitch tap gain, and $y_P(i)$ is the weighted unscaled synthesis filtered pitch excitation sequence, as derived from Equation (6) with $\beta=1$; i.e., the sequence $$\begin{aligned} y_P(i) &= y_P(i-P) \quad i < P \\ & \quad y_P(i-2P) \quad P \leqq i < 2P \\ & \quad y_P(i-3P) \quad 2P \leqq i < 3P \\ & \quad \text{etc.} \end{aligned}$$

Equation (7) differs from that for the standard CELP system in that the sequence $y_C(i)$ (in the standard system) is usually derived by passing the codeword excitation through both the pitch predictor filter and the LPC synthesis filter. As mentioned above, the lack of pitch filtering on the present-frame codeword excitation does not seem to impede the performance of the whole system.

Taking partial derivatives of Equation (7) with respect to $\beta$ and g, setting those equal to zero, and substituting auto- and cross-correlations where appropriate, results in a set of two simultaneous equations to solve:

$$\begin{bmatrix} \sigma_{yp}^2 & R_{CP} \\ R_{CP} & \sigma_{yC}^2 \end{bmatrix} \begin{bmatrix} \beta \\ g \end{bmatrix} = \begin{bmatrix} R_{xP} \\ R_{xC} \end{bmatrix} \quad (8)$$

where $\sigma_{yP}^2$ is the variance of the sequence $y_P(i)$, $\sigma_{yC}^2$ is the variance of the sequence $y_C(i)$, $R_{CP}$ is the cross-correlation of the weighted unscaled synthesis filtered pitch prediction sequence $y_P(i)$ and the synthesis filtered codeword sequence $y_C(i)$, $R_{xP}$ is the cross-correlation between the weighted input x(i) and pitch excitation sequence $y_P(i)$, and $R_{xC}$ is the cross-correlation between the weighted input x(i) and codeword sequence $y_C(i)$. By solving Equation (8) for $\beta$ and g, the optimal simultaneous solution for the pitch tap gain and codeword excitation gain is obtained.

Figure 3:
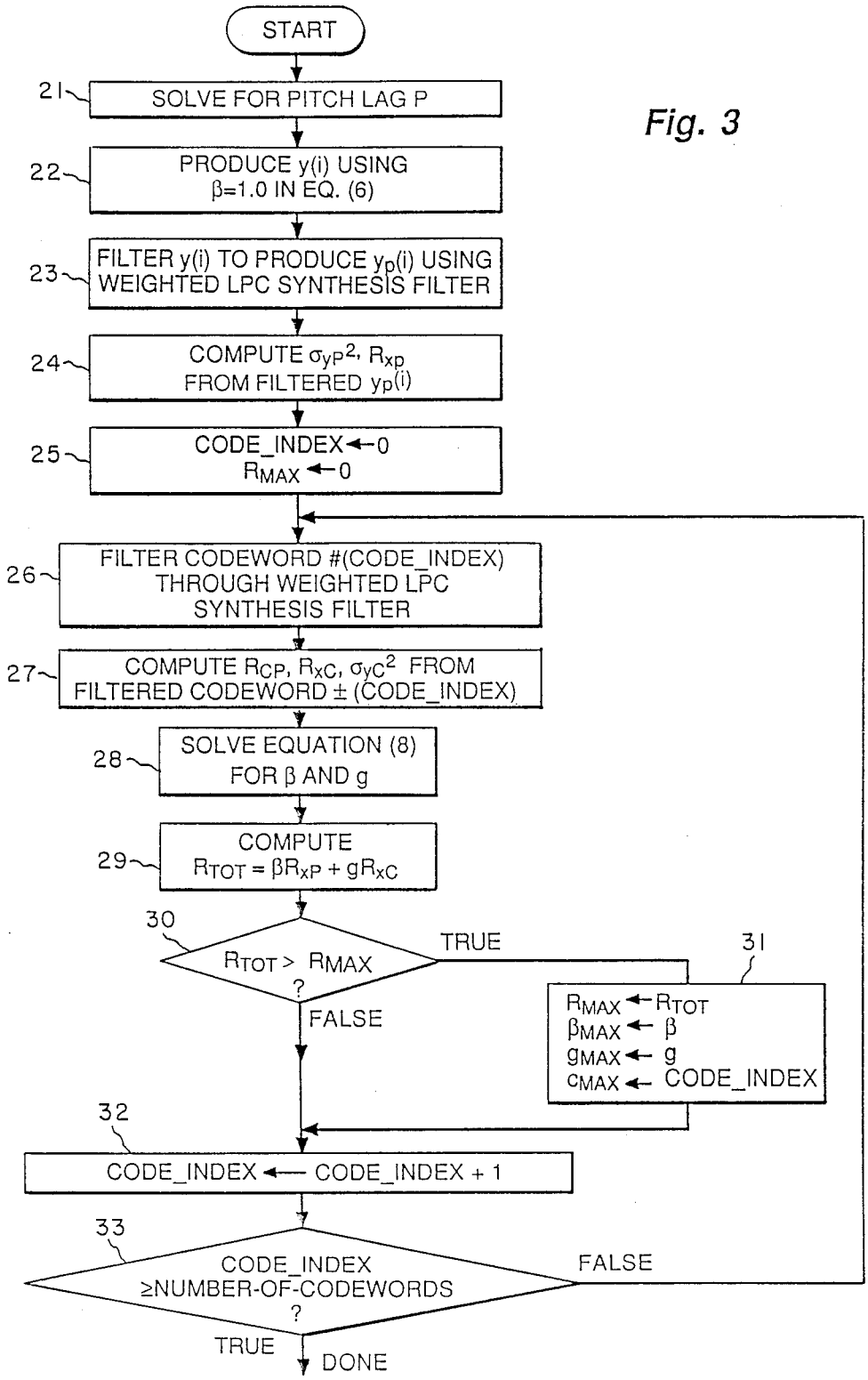
FIG. 3 is a flow diagram showing the process of determining the necessary gains, lags, and indices for generation of CELP excitation as implemented by the invention.

To see how these improvements are implemented in the analysis phase of the CELP coder, reference is made to FIG. 3, which shows a flow chart of the steps necessary for computing and/or selecting the necessary gains, lags, and indices for proper generation of the CELP excitation. The process starts by solving for pitch lag, P, at function block 21. Initially, the pitch lag is computed by finding the location of the maximum cross-correlation between the weighted input sequence and the synthesis-filtered contents of the pitch buffer. Using this value of P, an unscaled pitch prediction sequence is produced by using $\beta=1.0$ in equation (6), as indicated at function block 22. As shown in function block 23, this sequence is then passed through the weighted LPC synthesis filter to produce $y_P(i)$, the unscaled (weighted) LPC synthesis filtered pitch prediction sequence. The $y_P(i)$ sequence can then be used, as indicated in function block 24, to calculate the pitch prediction sequence variance $\sigma_{yP}^2$)) and the cross-correlation between the weighted input and weighted synthesis pitch prediction sequences ($R_{xP}$) for later use in Equation (8).

At this juncture, the Gaussian codebook search is initiated. The search is exhaustive; that is, every codeword in the codebook is tested. In FIG. 3, the codewords are referenced by their index number, denoted by the variable code_index. The search is initiated by setting code_index to 0 and $R_{max}$ to zero, as indicated in function block 25. Beginning with code_index at 0 and ending with code_index at one less than the number of codewords in the codebook, each codeword is filtered through the weighted LPC filter at function block 26, producing the codeword codebook sequence or output sequence $y_C(i)$. This sequence for the given codeword is then cross-correlated with the unscaled pitch prediction sequence $y_P(i)$, producing $R_{CP}$, and with the weighted input sequence, producing $R_{xC}$, at function block 27. Also, as indicated, in function block 27, the variance of $Y_C(i)$ (i.e., $\sigma_{yC}^2$) is estimated at this time. These values, together with the others calculated from the pitch prediction sequence earlier, are inserted into Equation (8) at function block 28 and Equation (8) is solved for $\beta$ and g. These are the optimal values of pitch tap gain and codeword gain, respectively, for the codeword indexed by code_index.

To choose the best codeword, the quantity $$R_{TOT} = \beta R_{xP} + g R_{xC}, \quad (9)$$

which is the total cross-correlation between the candidate output sequence and weighted input sequence, is calculated at function block 29. The codeword producing the maximum value of $R_{TOT}$ is the codeword that will have the lowest output distortion. Thus FIG. 3 depicts a simple algorithm using variables $R_{MAX}$, $\beta_{MAX}$, $g_{MAX}$, and $c_{MAX}$ to hold the optimum or "best" values during the codebook search. More specifically, each value of $R_{TOT}$ computed at function block 29 is tested at decision block 30 to determine if that computed value is greater than $R_{MAX}$ which is currently stored. If so, the values for $R_{TOT}$, $\beta$, g, and code_index are stored as the current values of $R_{MAX}$, $\beta_{MAX}$, $g_{MAX}$, and $c_{MAX}$ at function block 31. Then, or if the test at decision block 30 is false, code_index is incremented by one at function block 32 before a test is made at decision block 33 to determine if code_index is greater than or equal to number_of_codewords. If code_index is less than number_of_codewords, the next codeword is filtered through the weighted LPC filter at function block 26, and the process is repeated from that point on. The search is completed when code_index is equal to the number of codewords minus one, as indicated at decision block 33. At this juncture, the variables $R_{MAX}$, $\beta_{MAX}$, $g_{MAX}$, and $c_{MAX}$ hold the correct excitation parameters for synthesis of the output sequence.

Figure 4A:
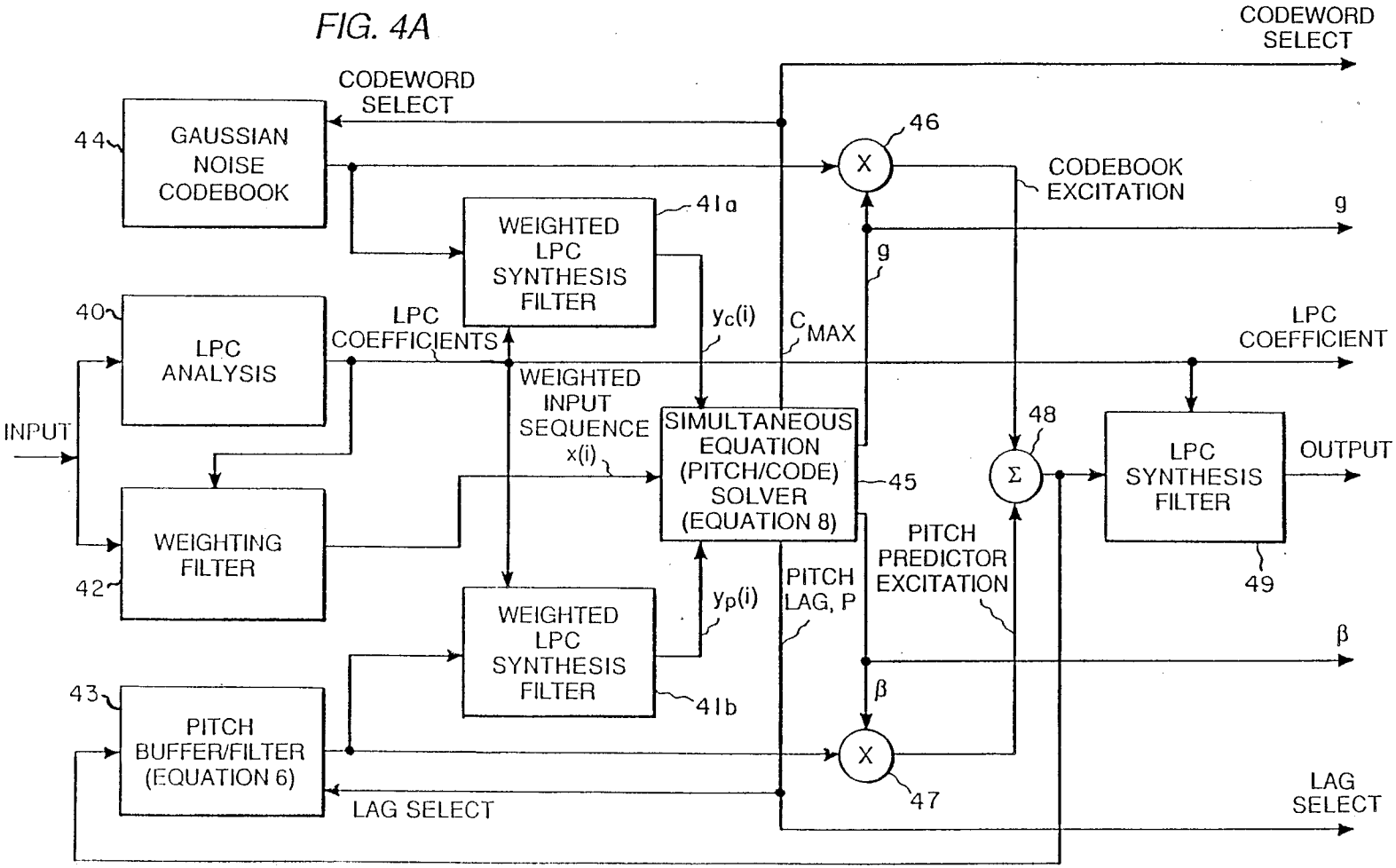
FIGS. 4A and 4B together constitute a functional block diagram showing implementation of the invention as illustrated in FIG. 3.
Figure 4B:
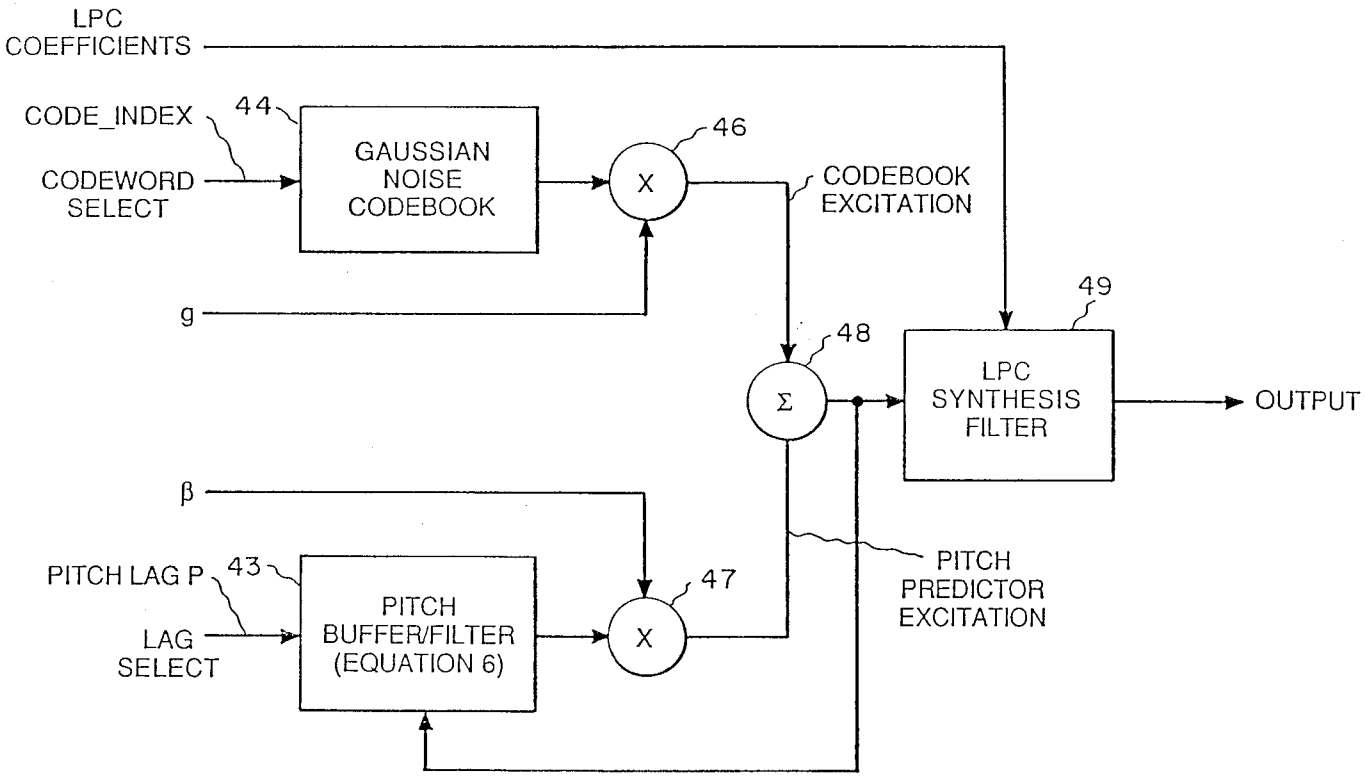

FIG. 4 is a block diagram of a CELP encoder that utilizes the improvements according to the invention. As in the FIG. 1 implementation, the input speech signal is first passed through an LPC analyzer 40 to produce a set of linear predictive filter coefficients. These coefficients are used in weighting filter 42 to produce the perceptually weighted input sequence x(i) that is used in the cross-correlations described earlier. The LPC coefficients are also provided to the weighted LPC synthesis filters 41*a* and 41*b* for filtering candidate codebook excitation sequences from Gaussian noise codebook 44 and the pitch prediction sequence from filter 43, respectively, in the receiving station shown in FIG. 4B. The subsystem formed by synthesis filters 41*a* and 41*b*, pitch filter 43, codebook 44, and a simultaneous equation solver 45 shown in FIG. 4A, implement the algorithm illustrated in FIG. 3. More specifically, simultaneous equation solver 45 solves equation (8) for the pitch tap gain $\beta$ and the codeword excitation gain g and, in addition, provides output signals for selecting the lag for pitch filter 43 and the codeword from Gaussian noise codebook 44 for performing the search. The simultaneous equation solver may be of the type which utilizes Gaussian elimination and backward substitution. Upon completion of the search in FIG. 3, the final values of code_index, P, g, and $\beta$ are used to synthesize the output excitation sequence in the system of FIG. 4B by scaling the codeword by g in a multiplier 46, scaling the pitch prediction sequence by $\beta$ in a multiplier 47, summing the output signals of both multipliers in a summer 48 and applying the result to an LPC synthesis filter 49. The feedback path from summer 48 to pitch buffer/filter 43 provides the buffer with the proper prediction sequences to use in subsequent frames.

FIG. 4B shows a block diagram of a remote receiving station for the encoder of FIG. 4A. The parameters of code_index, codeword gain g, pitch lag P, and pitch tap gain $\beta$ are received and used to reconstruct excitation filter 49 in the following manner. Code_index is used to look up the corresponding codeword in Gaussian noise codebook 44. The codeword output signal of codebook 44 is then scaled by the gain g in multiplier 46. The unscaled pitch prediction sequence is produced by supplying the pitch lag to pitch filter 43, and scaling the resulting sequence by $\beta$ in multiplier 47. The output signals of multipliers 46 and 47 are summed in summer 48 to produce the excitation sequence. To produce the output sequence, the LPC coefficients are received from the encoder used in LPC synthesis filter 49. Filter 49 filters the excitation sequence from summer 48 to produce the receiving station output signal. As in the encoder, the feedback path from summer 48 to pitch buffer/filter 43 provides the buffer with the proper prediction sequences to use in subsequent frames.

A CELP coder with the improvements described above was implemented and compared with a base coder of similar design and identical transmission rate. Table 1 gives the pertinent details for both coders.

TABLE 1

| Analysis Parameters of Tested Coders | |
|---|---|
| Sampling Rate | 8 KHz |
| LPC Frame Size | 256 samples |
| Pitch Frame Size | 64 samples |
| # Pitch Frames/LPC Frame | 4 frames |
| Codebook Size | 128 vectors |

The baseline coder used the codeword gain estimator of Equation (1), with both pitch synthesis and LPC synthesis filtering on the codeword excitation; it also used the pitch gain estimator of Equation (5) and the pitch prediction synthesis filter of Equation (3), and it sequentially solved for the pitch predictor parameters first, and then found the codeword gain and index. The improved coder according to the invention used the pitch gain estimator of Equation (5), the pitch predictor synthesis filter of Equation (6), the simultaneous pitch gain/codeword gain and index optimization algorithm of Equation (8), and the sequence of operations illustrated in FIG. 3. Both coders were used to code 18.25 seconds of speech, consisting of equal amounts of male and female speech. In making signal-to-noise ratio (SNR) measurements for this segment of speech, four different measures were employed as described below:

SNR -t (Total Segmental SNR): The segmental SNR as measured by $$SNR - t(\mathrm{dB}) = \frac{\sum_{j=0}^{L-1}\left\{10\,\mathrm{Log}_{10}\left[\frac{\sum_{i=0}^{N-1} x_j^2(i)}{\sum_{i=0}^{N-1}(x_j(i)-y_j(i))^2}\right]\right\}}{L}$$

where L is the number of blocks in the average, N is the size of one block, $x_j(i)$ is the $i^{th}$ observed input sample in the $j^{th}$ block, and $y_j(i)$ is the $i^{th}$ observed output sample in the $j^{th}$ block.

WSNR-t (Weighted Total Segmental SNR): Similar to SNR-t, except that the perceptually weighted error is used in the measurement.

$$WSNR - t(\mathrm{dB}) = \frac{\sum_{j=0}^{L-1}\left\{10\,\mathrm{Log}_{10}\left[\frac{\sum_{i=0}^{N-1} x_j^2(i)}{\sum_{i=0}^{N-1} e_{pj}^2(i)}\right]\right\}}{L}$$

A discussion of the filter used to obtain the weighted sequence $e_p^2(i)$ can be found in B. S. Atal, "Predictive Coding of Speech at Low Bit Rates", *IEEE Transactions on Communications*, vol. COM-30, April 1982, pp. 600–614. WSNR-t should more accurately reflect the perceived speech quality than SNR-t.

SNR-v (Voiced Speech Segmental SNR): Measured with the same technique as SNR-t, except that only frames with a high energy level are used. SNR-v reflects the reproduction quality of the voiced speech only, while SNR-t counts unvoiced speech and silence periods.

WSNR-v (Voiced Speech Weighted Segmental SNR): As in SNR-v, but using perceptually weighted error sequence. Using these measures, the data in Table 2 were collected.

TABLE 2

| Measured SNR for Baseline and Improved Coders | | | | |
|---|---|---|---|---|
| Coder | SNR-t | WSNR-t | SNR-v | WSNR-v |
| Baseline | 4.95 | 8.96 | 7.40 | 12.34 |
| Improved | 6.08 | 9.76 | 8.42 | 13.08 |

As shown in Table 2, the improvements derived from the present invention increase the SNR by about 1.0 dB, depending on the measurement technique.

Another benefit of the present invention comes from the complexity reduction inherent in the new pitch prediction technique. As previously mentioned, standard CELP requires that each codeword in the codebook be filtered by both the LPC and pitch synthesis filters. The improved technique according to the invention does not require the codebook entries to be filtered by the pitch synthesis filter. This results in a substantial savings in multiply/accumulate operations, while at the same time providing the SNR improvements given above.

While only certain preferred features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method for improving speech quality in code excited linear predictive voice coders, comprising the steps of:

determining a pitch predictor tap gain as a normalized cross-correlation of an input sequence and pitch buffer samples by copying previous samples at a distance of P samples so as to extend pitch buffer length;

modifying a pitch synthesis filter so that a pitch predictor output sequence is a series computed for each interval P; and simultaneously solving for pulse amplitudes and pitch tap gain, thereby minimizing estimator bias in the code excitation.

2. A code excited linear predictive coder comprising:

linear predictive code analysis means for receiving an input signal and generating from said input signal a set of linear predictive filter coefficients;

weighting means for receiving said input sequence and said set of linear predictive filter coefficients for generating a weighted input sequence;

codebook means for generating output codewords;

first weighted linear predictive synthesis filter means responsive to said set of linear predictive filter coefficients and said codewords for generating synthesis filtered codewords;

pitch filter means for generating pitch excitation sequences;

second weighted linear predictive synthesis filter means responsive to said set of linear predictive filter coefficients and said pitch excitation sequences for generating synthesis filtered pitch excitation sequences;

equation solving means receiving said weighted input sequence, said synthesis filtered codewords and said synthesis filtered pitch excitation sequences for computing a pitch predictor tap gain and a codeword excitation gain;

first multiplying means for multiplying said codebook output sequences by said codeword excitation gain to produce a codebook excitation output signal;

second multiplying means for multiplying said pitch excitation sequences by said pitch predictor tap gain to produce a pitch predictive excitation; and summing means for summing said codebook excitation output signal and said pitch predictive excitation to generate a combined excitation to be transmitted with said linear prediction coefficients.

3. The code excited linear predictive coder recited in claim 1 further comprising linear predictive synthesis filter means responsive to said linear predictive coefficients and said combined excitation for generating an output signal that closely resembles said input signal.

4. A method of generating an excitation sequence for transmission with linear predictive coefficients of an input signal in a code excited linear predictive speech coder, comprising the steps of:

computing a pitch lag by finding the location of a maximum cross-correlation between a weighted input sequence and synthesis-filtered contents of a pitch buffer of the coder;

generating an unscaled pitch prediction sequence using the computed pitch lag and a pitch tap gain of 1.0;

passing the unscaled pitch prediction sequence through a weighted linear predictive synthesis filter to produce an unscaled weighted synthesis pitch prediction sequence;

computing a pitch prediction sequence variance from the unscaled weighted synthesis pitch prediction sequence and a cross-correlation between the weighted input sequence and unscaled weighted synthesis pitch prediction sequence;

conducting an exhaustive Gaussian codebook search and, for each codeword output sequence obtained from said codebook, computing a codeword output sequence variance and a cross-correlation between the codeword output sequence and the weighted input sequence;

determining optimal values for codeword gain and pitch tap gain from said computed variances and said cross-correlations;

multiplying the pitch prediction sequence by the optimal value of pitch tap gain to arrive at a scaled pitch prediction sequence;

multiplying the codeword output sequence by the optimal codeword gain to arrive at a scaled codeword sequence; and summing the scaled pitch and codeword sequences to generate parameters representing said excitation sequence.

5. The method of generating an excitation sequence as recited in claim 4 further comprising the step of transmitting said parameters representing an excitation sequence together with said linear prediction coefficients.

6. The method of generating an excitation sequence as recited in claim 5 further comprising the step of utilizing said excitation sequence and said linear prediction coefficients for synthesizing an output signal which closely resembles said input signal.

* * * * *